US005512918A

United States Patent [19]

Forrest et al.

[11] Patent Number: 5,512,918

[45] Date of Patent: Apr. 30, 1996

[54] HIGH SPEED METHOD AND APPARATUS FOR GENERATING ANIMATION BY MEANS OF A THREE-REGION FRAME BUFFER AND ASSOCIATED REGION POINTERS

[75] Inventors: Craig S. Forrest, San Francisco; Edward H. Frank, Portola Valley; Patrick J. Naughton, Palo Alto, all of Calif.

[73] Assignee: Sun Microsystems, Inc., Mountain View, Calif.

[21] Appl. No.: 322,361

[22] Filed: Oct. 13, 1994

Related U.S. Application Data

[63] Continuation of Ser. No. 106,281, Aug. 13, 1993, abandoned.

[51] Int. Cl.[6] ..... G09G 5/34

[52] U.S. Cl. ..... 345/122; 345/201

[58] Field of Search ..... 345/121, 201, 345/200, 187, 122, 203, 185; 395/152

[56] References Cited

U.S. PATENT DOCUMENTS

| | | | |
|---|---|---|---|
| 4,825,381 | 4/1989 | Bottorf et al. | 345/201 |
| 4,910,670 | 3/1990 | Smith et al. | 345/200 |
| 4,961,071 | 10/1990 | Krooss . | |
| 4,988,985 | 1/1991 | Barkans et al. | 345/187 |
| 5,150,312 | 9/1992 | Beitel et al. | 345/122 |

FOREIGN PATENT DOCUMENTS

| | | | |
|---|---|---|---|
| 0265643 | 9/1987 | European Pat. Off. | G09G 1/00 |
| 0403122 | 5/1990 | European Pat. Off. | G09G 1/16 |

OTHER PUBLICATIONS

"Three–Buffer Display System for Realtime Animation"; Aug. 1987; pp. 1266–1268 [*IBM Technical Disclosure Bulletin,* vol. 30, No. 3].

"CRT Video Storage Access Method"; Jun. 1986; pp. 392–393 [*IBM Technical Disclosure Bulletin,* vol. 29, No. 1].

*Primary Examiner*—Curtis Kuntz
*Assistant Examiner*—Vivian W. Chang
*Attorney, Agent, or Firm*—Irell & Manella

[57] ABSTRACT

A method and apparatus for quickly copying a first frame region into a second frame region. A video memory array comprising a plurality of video random access memory devices is divided into at least two frame regions. A background image is rendered by a central processing unit into a background frame region within the video memory array. The central processing unit then requests the background image in the background frame region to be copied into a new frame region in the video memory array. A dedicated circuit copies the entire background image in the background frame region into the new frame region. The dedicated circuit operates by using a serial data register within each video random access memory device during the vertical retrace period of a video timing signal. The dedicated circuit performs the background frame copy without requiring any processing resources from the central processing unit.

10 Claims, 14 Drawing Sheets

NEW FRAME REGISTER IS NULL

NEW FRAME REGISTER IS NULL

HIGH SPEED METHOD AND APPARATUS FOR GENERATING ANIMATION BY MEANS OF A THREE-REGION FRAME BUFFER AND ASSOCIATED REGION POINTERS

This is a continuation of copending application(s) 08/106,281, now abandoned, filed Aug. 13, 1993.

1. Field of the Invention

This invention relates to the field of frame buffers for computer systems. More particularly, to a method and apparatus for quickly copying information from a first region of memory in a frame buffer to a second region of memory in the frame buffer.

2. Art Background

Many computer systems use a region of memory called a frame buffer for storing data that is to be displayed on a graphics display screen. A display control system reads the information in the frame buffer line-by-line, converts the information into an analog video signal using a digital to analog converter (DAC), and transmits the analog video signal to a display screen. The line-by-line scanning generally beginning at a region in the frame buffer corresponding to the upper left-hand corner of the display screen and continuing to the lower right-hand corner.

Typically, a frame buffer is constructed of video random access memory (VRAM) devices that differ from conventional dynamic random access memory (DRAM) devices by having two access ports instead of just one access port. A first access port, called a random access port, provides conventional random access to the VRAM such that a central processing unit coupled to the VRAM may read or write to any memory location in the VRAM. A second port, called a serial access port, provides simultaneous serial access to the VRAM such that a device coupled to the serial port can shift data in or out of the VRAM. A display circuit usually accesses the serial port to furnish pixel data to the circuitry controlling the output display. In such a configuration, a central processing unit can write to the VRAM while a display circuit continually furnishes information to an output display.

To animate objects on a display screen coupled to a frame buffer based display system, animation software renders a series of frames with slight picture changes in each frame. To provide smooth animation, approximately 15 to 30 new frames should be displayed each second. As the picture in one frame changes to the picture in the next frame, continuous motion is presented. To accomplish this, the frame buffer must be continually updated.

The ability of a frame buffer to both receive information and transfer that information to an output display simultaneously causes certain difficulties. If the animation software writes to frame buffer memory while the display controller is scanning the image in the frame buffer memory to a display, then the display may present information from more than one animation frame at time. This problem is referred to as frame tear. Frame tears are only important where motion from one frame to the next causes the elements presented on the display to be obviously distorted. When this occurs, the distortion caused may be extremely disconcerting to the viewer.

To eliminate frame tears, certain computer systems utilize a system referred to as double buffering. A double buffered system provides two regions of memory in the frame buffer wherein each region of memory may furnish pixel information to the circuitry controlling the output display. A first region of memory provides a first animation frame to the output display, and no changes are made in that memory region while it provides information to the display screen. While the first memory region is displayed on the display screen, animation software renders the next animation frame in the second region of memory. When the animation software completes the next animation frame the display is changed such that the second region of memory becomes the displayed frame and the first region of memory becomes the "work" region in which the animation software renders the next animation frame. In this manner, no pixel information is ever written to the region of memory that is displayed on the display screen. The effect of writing to the non-displayed buffer is that frame tears cannot occur.

When animating objects using a double-buffered animation frame, the CPU must render every object to be displayed in the work region for each new frame of animation. If the animated objects are being rendered on top of a background scene, the entire background scene must also be redrawn by the CPU before it can render the animated objects. To provide high-quality real time animation, the rendering of the background and the animated objects for an animation frame must be done approximately 15 to 30 times per second. Real-time animation therefore usually requires a very fast computer processor.

SUMMARY OF THE INVENTION

It is therefore an object of the present invention to provide an improved display control system that reduces the amount of processor speed required to provide real-time animation. The present invention accomplishes this object by providing a method and apparatus for copying an entire background image frame from a background region of memory in a frame buffer into a new frame region of memory in the frame buffer. The apparatus operates when requested by the central processing unit of the computer system. The central processing unit requests a background copy by setting a new frame register in the copy apparatus to point to an empty region of memory and setting a bit in a control register. The apparatus of the present invention performs the background copy without requiring any processing resources from the central processing unit.

BRIEF DESCRIPTION OF THE DRAWINGS

The objects, features, and advantages of the present invention will be apparent to one skilled in the art in view of the following detailed description in which.

NOTATION AND NOMENCLATURE

Figure 1:
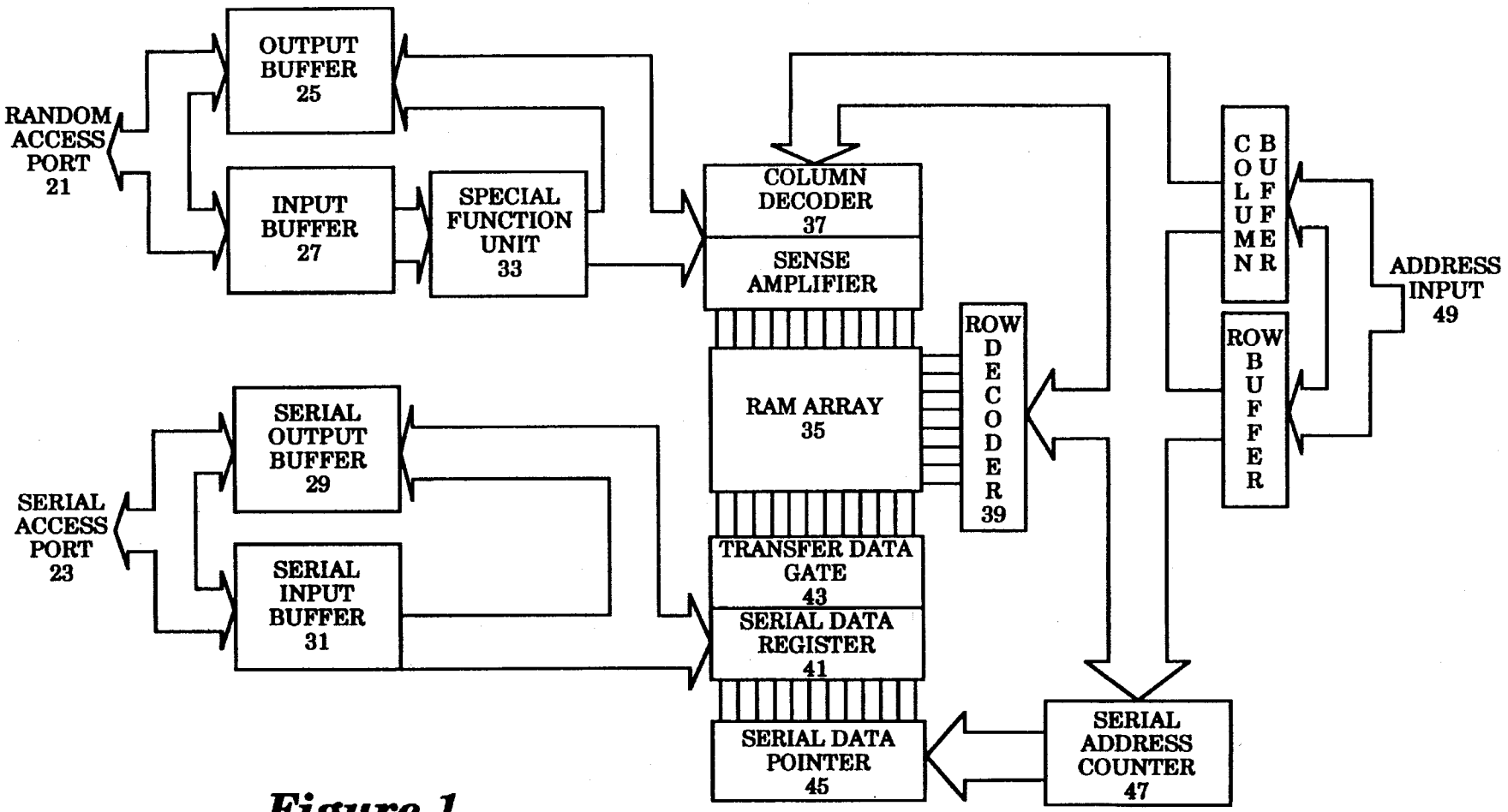
Figure 1 (Prior Art)
FIG. 1 illustrates a conventional video random access memory device (VRAM).

The detailed descriptions that follow are presented largely in terms of algorithms and symbolic representations of operations on data bits within a computer memory. These algorithmic descriptions and representations are the means used by those skilled in the data processing arts to most effectively convey the substance of their work to others skilled in the art.

An algorithm is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein that form part of the present invention; the operations are machine operations. Useful machines for performing the operations of the present invention include general purpose digital computers or other similar devices. In all cases there should be borne in mind the distinction between the method operations in operating a computer and the method of computation itself. The present invention relates to method steps for operating a computer in processing electrical or other (e.g., mechanical, chemical) physical signals to generate other desired physical signals.

The present invention also relates to apparatus for performing these operations. This apparatus may be specially constructed for the required purposes or it may comprise a general purpose computer as selectively activated or reconfigured by a computer program stored in the computer. The algorithms presented herein are not inherently related to a particular computer or other apparatus. In particular, various general purpose machines may be used with programs written in accordance with the teachings herein, or it may prove more convenient to construct more specialized apparatus to perform the required method steps. The required structure for a variety of these machines will appear from the description given below.

DETAILED DESCRIPTION OF THE INVENTION

A computer display system with a fast copy means is disclosed. In the following description, for purposes of explanation, specific nomenclature such as icons, displays, cursors, reticle, etc. is set forth to provide a thorough understanding of the present invention. However, it will be apparent to one skilled in the art that these specific details are not required in order to practice the present invention. In other instances, well known circuits and devices are shown in block diagram form in order not to obscure the present invention unnecessarily.

A Video Random Access Memory

Referring to FIG. 1, a simplified block diagram of a typical Video Random Access Memory (VRAM) device is illustrated. In the center of the VRAM is a dynamic random access memory array 35 that is used to store data. The RAM array 35 is organized into a set of rows and columns such that each memory location in the RAM array 35 is defined by a row address and a column address. The memory in the RAM array 35 of FIG. 1 can be accessed by two different access ports: a random access port 21 and a serial access port 23.

The random access port 21 is usually used by a central processing unit (CPU) (not shown) in a computer system to read and write to the video memory. The CPU generates images on a display screen by writing image patterns in the VRAM array 35 through the random access port 21. To access a specific memory location in the VRAM array 35, the CPU first generates an address that is latched in through the address lines 49. The address is split into a row address and a column address. The row decoder 39 and column decoder 37 use the row address and column address to access a specific memory location in the RAM array 35. The CPU then either writes data to the input buffer 27 or reads data from output buffer 25 depending upon if the memory access is a write access or a read access.

The serial access port 23 of the VRAM is usually used by a display control system (not shown) in a computer system to read the image in the VRAM and send the image to a display. The display control system accesses the data in the video memory by first providing a row address to the address input 49 and requests the VRAM to transfer the entire memory row into the serial data register 41. The row decoder 39 selects a row in the RAM array 35 using the row address and transfers the selected row into the serial data register 41. The display control system then has the VRAM shift the data in the serial data register 41 out through serial output buffer 29 to the serial access port 23. A digital-to-analog converter (not shown) connected to the serial access port 23 uses the data to generate a video signal. The analog video signal drives a computer display.

In some devices that use VRAMs, such as a video frame grabber, the serial access port 23 is used as an input port instead of an output port. Such devices shift video information that has been converted into digital data into the serial data register 41 through serial input buffer 31. The device then provides a destination row address to the address input 49. The VRAM writes the digital information in the serial data register 41 into a row of the RAM array 35 selected by the row decoder 39 using the destination row address. Thus the serial data register 41 can be used to write data into the video memory array 35 as well as read information out of the video memory array 35.

A Conventional Display Control System

Figure 2:
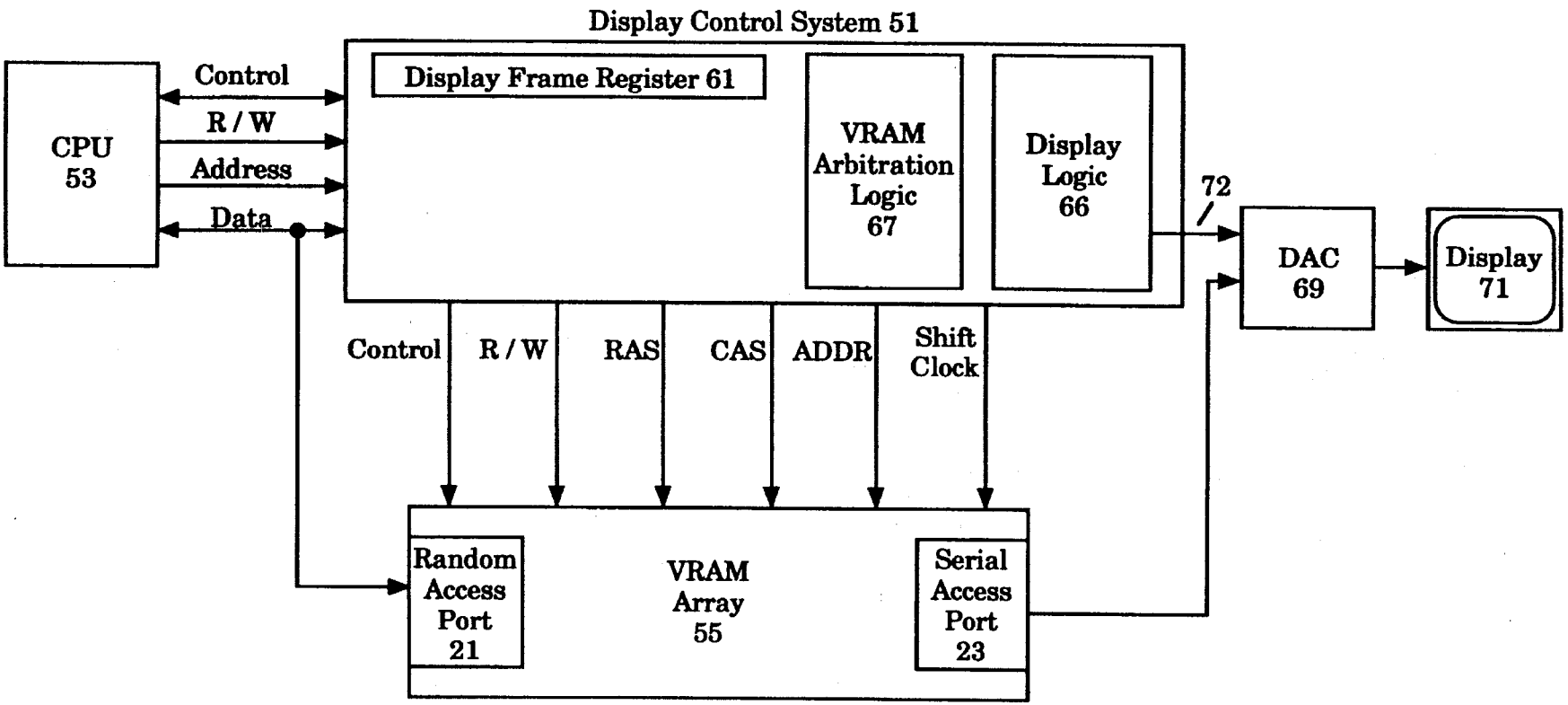
Figure 2 (Prior Art)
FIG. 2 illustrates a block diagram of a conventional computer display system that uses a frame buffer comprised of VRAM.

FIG. 2 illustrates a typical prior art computer display system. The computer display system comprises a central processing unit (CPU) 53, a display control system 51, a VRAM array 55, a digital to analog converter (DAC) 69, and a display screen 71. The VRAM array 55 comprises a number of individual VRAM devices, such as the VRAM device disclosed in FIG. 1, as is well known in the art.

The main component of the computer display system illustrated in FIG. 2 is the display control system 51. The display control system 51 is coupled to the CPU 53 such that the CPU 53 can control the display control system 51 using a set of memory-mapped control registers. The display control system 51 is comprised of two main logic units: the display logic 66 and the VRAM arbitration logic 67.

The display logic 66 accesses a logically rectangular region of memory in the VRAM array 55 that defines an image to display on the display screen 71. The display frame register 61 contains the starting address of the frame region within the VRAM array 55. The display logic 66 generates a video timing signal 72. The display logic 66 uses the display frame register 61 to access the frame region in the VRAM array 55 in synchronization with the video timing signal 72. The display logic 66 shifts the data describing an image out of the VRAM array 55 through the serial access port 23 to a digital-to-analog converter (DAC) 69. The display logic 66 also provides the video timing signal 72 to the digital-to-analog converter (DAC) 69.

The digital-to-analog converter (DAC) 69 combines the video timing signal 72 and the image data shifted out of the VRAM array 55 to generate an analog video signal. The analog video signal drives a computer display 71.

The VRAM arbitration logic 67 in the display control system 51 arbitrates between VRAM access requests from the CPU 53 and the display logic 66. The VRAM arbitration logic 67 gives the display logic 66 priority such that if there is a conflict, the display logic 66 gets to access the VRAM array 55. Since the display logic 66 must provide information from the VRAM in synchronization with the video timing signal 72, the VRAM arbitration logic 67 gives priority to the display logic 66.

Display Control System with Fast Frame Copy

Figure 3A:
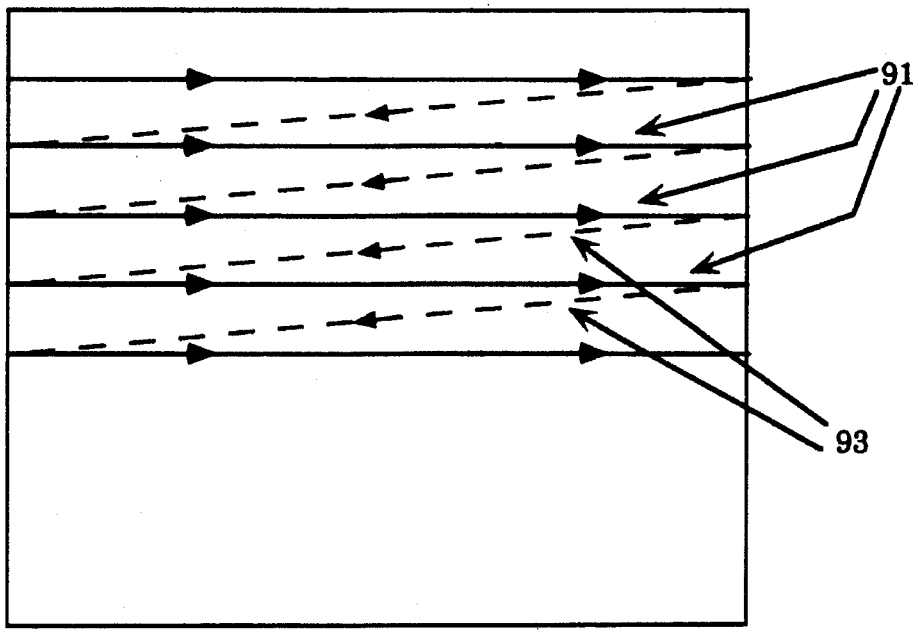
FIGS. 3*a* and 3*b* illustrate how a video signal scans down a display screen.
Figure 3B:
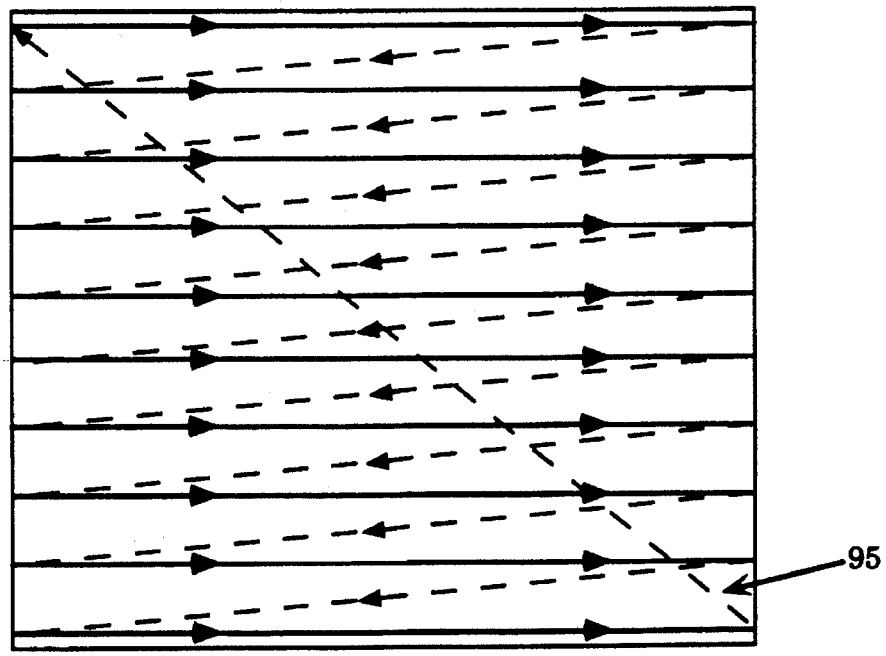

FIGS. 3*a* and 3*b* provide a simplified conceptual illustration of a video signal scanning down a video display screen. Referring to FIG. 3*a*, a video signal scans the display screen starting from the upper left corner. The video signal scans a line of information as it moves left to right across each horizontal scan line 91. At the end of each scan line, a horizontal retrace 93 moves the video signal back to the left side of the display screen. When the video signal reaches the bottom of the display, a vertical retrace 95 moves the video signal back to the top of the display screen.

During the time periods that the video signal is executing a horizontal retrace 93 or a vertical retrace 95 no data is displayed on the display. Therefore, during the horizontal retrace and vertical retrace periods the display logic 66 in a typical display control system 51 does not access the VRAM array 55. Since the display control system 51 does not access the VRAM during the retrace periods, another device can use the serial data register 41, as illustrated FIG. 1, during the retrace periods.

In the preferred embodiment, the present invention uses the serial data register 41 in each VRAM during the vertical retrace to copy the entire contents of a first memory region in the frame buffer to a second memory region. The display control system performs the memory region copy without using the central processing unit. In this manner, the central processing unit can be used for other matters such as rendering animated objects. The computer display system of the present invention will be described with reference to FIGS. 4, 5, 6, and 7.

Figure 4:
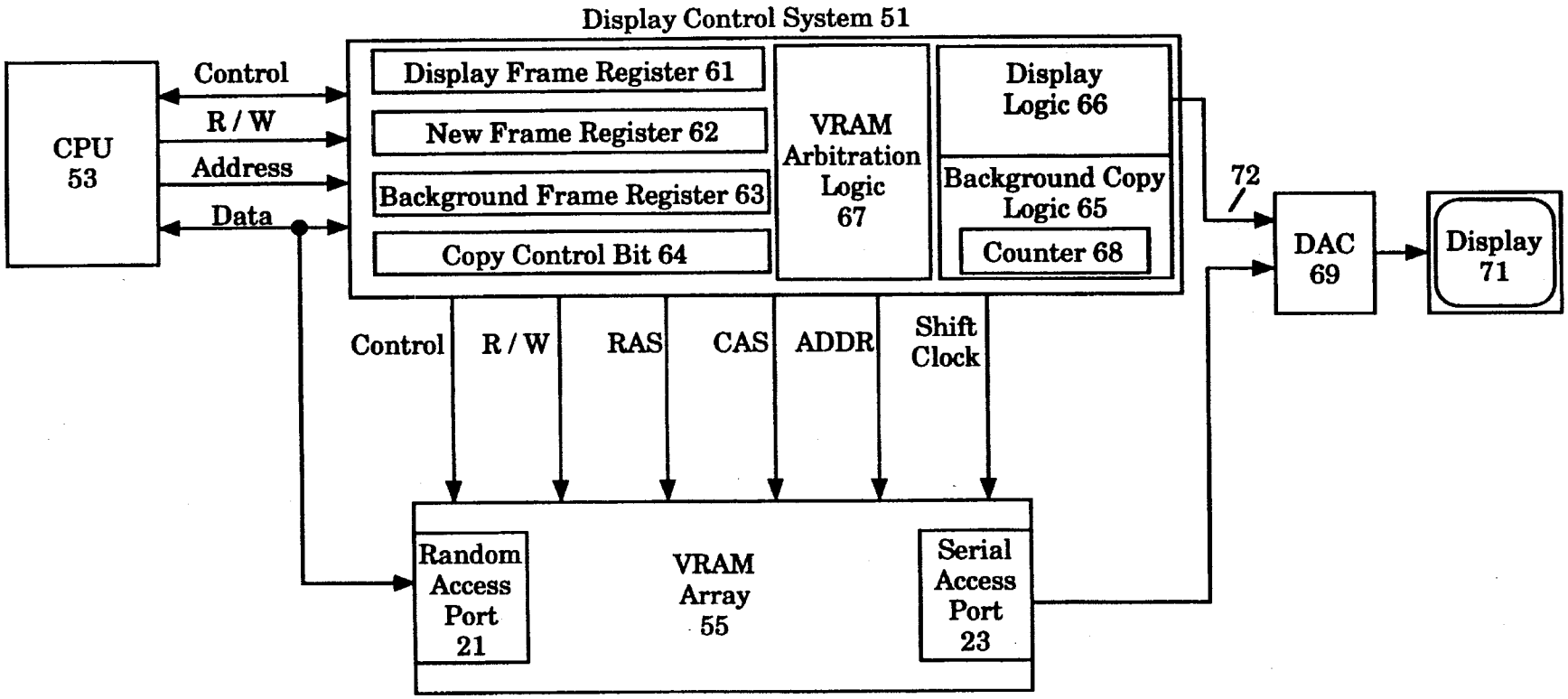
FIG. 4 illustrates a block diagram of the computer display system of the present invention.

FIG. 4 illustrates a block diagram of computer display system utilizing the teachings of the present invention. The computer display system illustrated in FIG. 4 is similar to computer display system of FIG. 2, except that a new frame register 62, a background frame register 63, a control register 64, and background copy logic 65 have been added.

The background frame register 63 is set by the CPU 53 to point to a region of memory within the VRAM array 55 containing background scene. The new frame register 62 is set by the CPU 53 to point to a "work" region in which the next frame of animation is created by the CPU 53 when performing double buffered animation. The work region is referred to as the new frame region. When requested by the CPU 53, the background copy logic 65 copies the entire rectangular region of memory defining a background pointed to by the background frame register 63 to the new frame region pointed to by the new frame register 62 during a retrace period of the video signal.

The control register 64 is used to perform several different functions. Within the control register 64 is a copy control bit. The copy control bit is set by the CPU 63 when the program needs a background copy performed. The control register 64 is also used to enable or disable a pair of interrupts. The first interrupt controlled by the control register 64 is the vertical retrace interrupt. If the vertical retrace interrupt is enabled, the vertical retrace interrupt generates a CPU interrupt when the vertical retrace period begins. The second interrupt controlled by the control register 64 is the copy complete interrupt. If the copy complete interrupt is enabled, the copy complete interrupt generates a CPU interrupt when a background copy performed by the background copy logic is complete. The vertical retrace interrupt and the copy complete interrupt are used by animation rendering programs such that the animation rendering programs can synchronize with the background copy operation.

Figure 5:
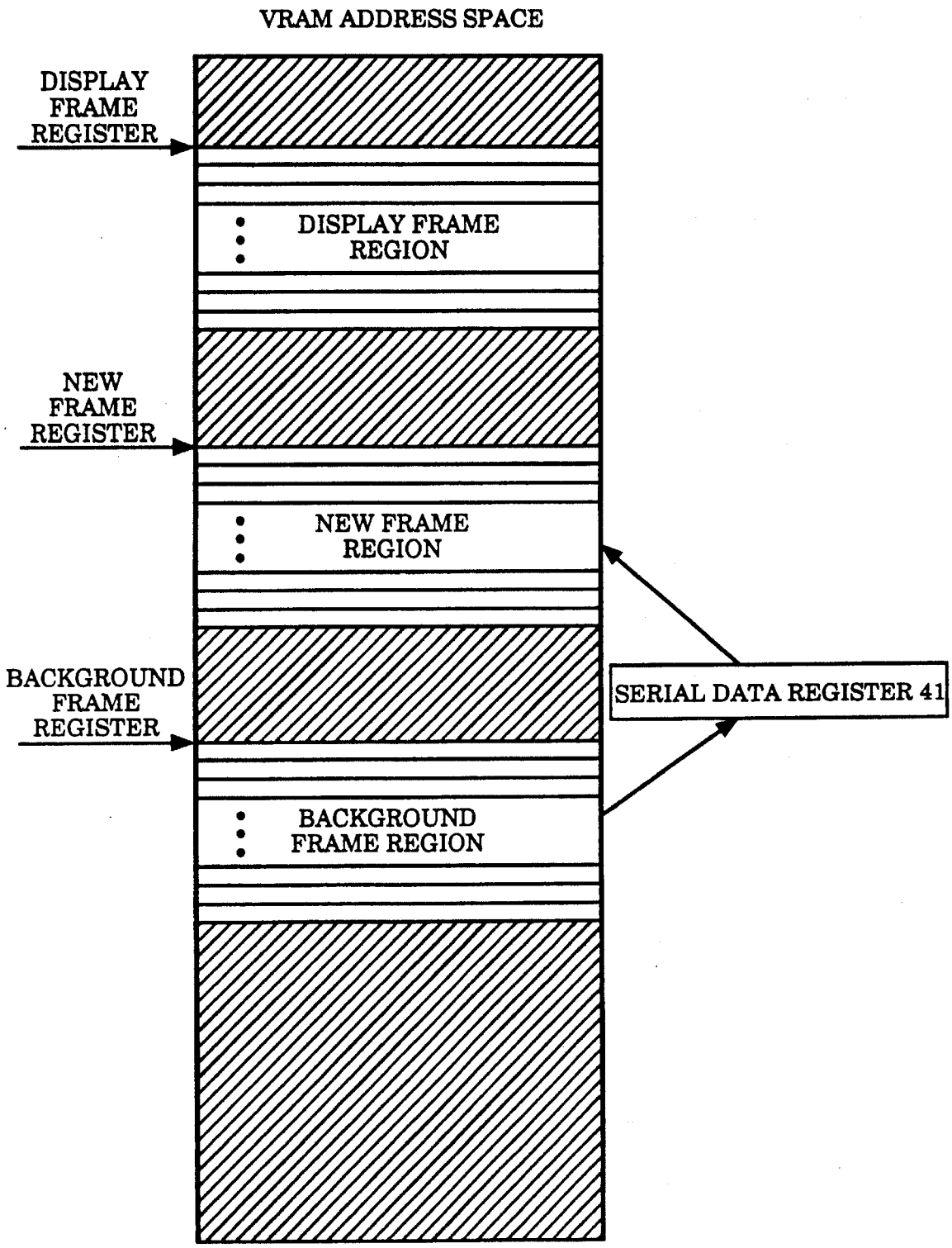
FIG. 5 illustrates a memory map of the VRAM address space as used by the display control system of the present invention.

The background copy operation is best explained with the use of a flow diagram and a memory map. Referring to FIG. 5, a memory map of the VRAM array 55 address space is illustrated. In the memory map of FIG. 5, the display frame register 61, a new frame register 62, and a background frame register 63 each point to a display frame region, a new frame region, and a background frame region within the VRAM address space, respectively. The display frame region contains the frame that is currently being displayed on the display screen. The new frame region contains an animation frame that is currently under construction and will be displayed in the future. The background region contains the background scenery for the animation. The contents of the background region is copied into the new frame region before each animation frame is rendered. There may be more than one background region in memory such that several different background scenes may be available. The animation sets the background frame register to choose between several background scenes. The display frame region, the new frame region, and the background frame region are all aligned in memory.

Figure 6:
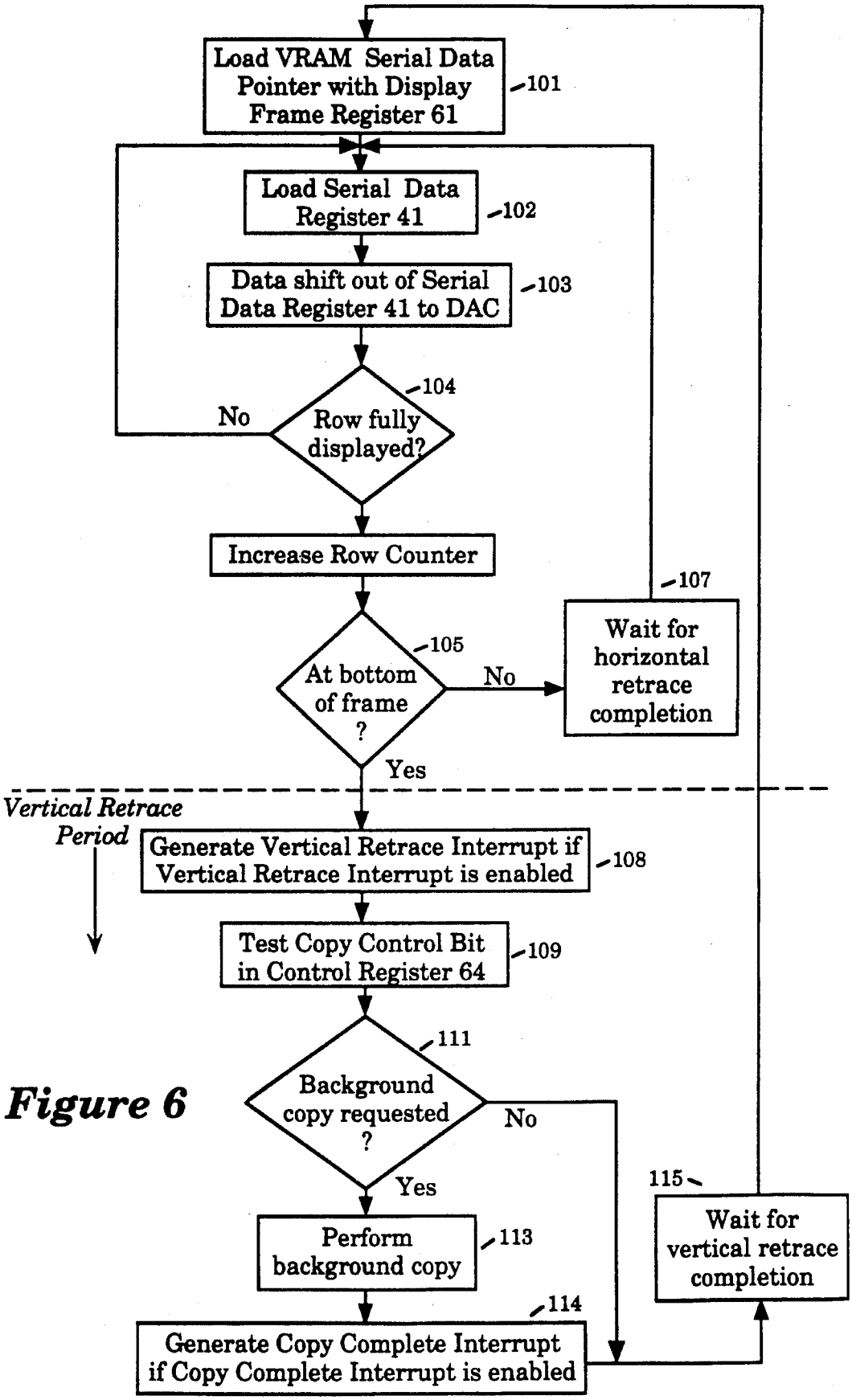
FIG. 6 illustrates a flow diagram of the display logic in the display control system of the present invention.

FIG. 6 provides a flow diagram that explains how the display logic 66 in the display control system 51 of the present invention operates. Referring to step 101 at the top of the flow diagram in FIG. 6, the display logic 66 first loads the serial data pointer 45 (of FIG. 1) in the VRAM with the contents of the display frame register 61 such that the serial data pointer 45 points to the first line in the display frame region. Next, in step 102, the display logic 66 loads the serial data register 41 with some or all of the first horizontal line. At step 103, the display logic 66 shifts the horizontal line data in the serial data register 41 out of the VRAM array 55 and into the digital-to-analog converter (DAC). (As indicated by step 104, steps 102 and 103 may be repeated if the entire horizontal display line was not shifted out to the display.) At step 105, the display logic 66 tests to see if the bottom of the display frame has been reached. If the bottom of the display frame has not been reached the display logic 66 waits for the horizontal retrace to complete and then goes back to step 102. The display logic 66 repeats steps 102, 103, 105, and 107, until all the horizontal rows of data have been shifted out of the VRAM array 55 and into the digital-to-analog converter (DAC) thereby displaying a full frame.

After the display logic 66 reaches the bottom of the display frame, the display logic generates a vertical retrace interrupt at step 108 if the vertical retrace interrupt is enabled. Next, the display logic 66 tests the copy control bit in the control register 64 at step 109. If the copy control bit in the control register 64 is set, the display control system 51 invokes the background copy logic 65 at step 113. After the background copy has been performed, the display logic 66 generates the copy complete interrupt at step 114 if the copy complete interrupt is enabled. The copy complete interrupt informs the CPU that copy operation has completed. Finally, the display logic 66 waits at step 115 until the vertical retrace period completes and then begins shifting out another frame to the DAC 69.

Figure 7:
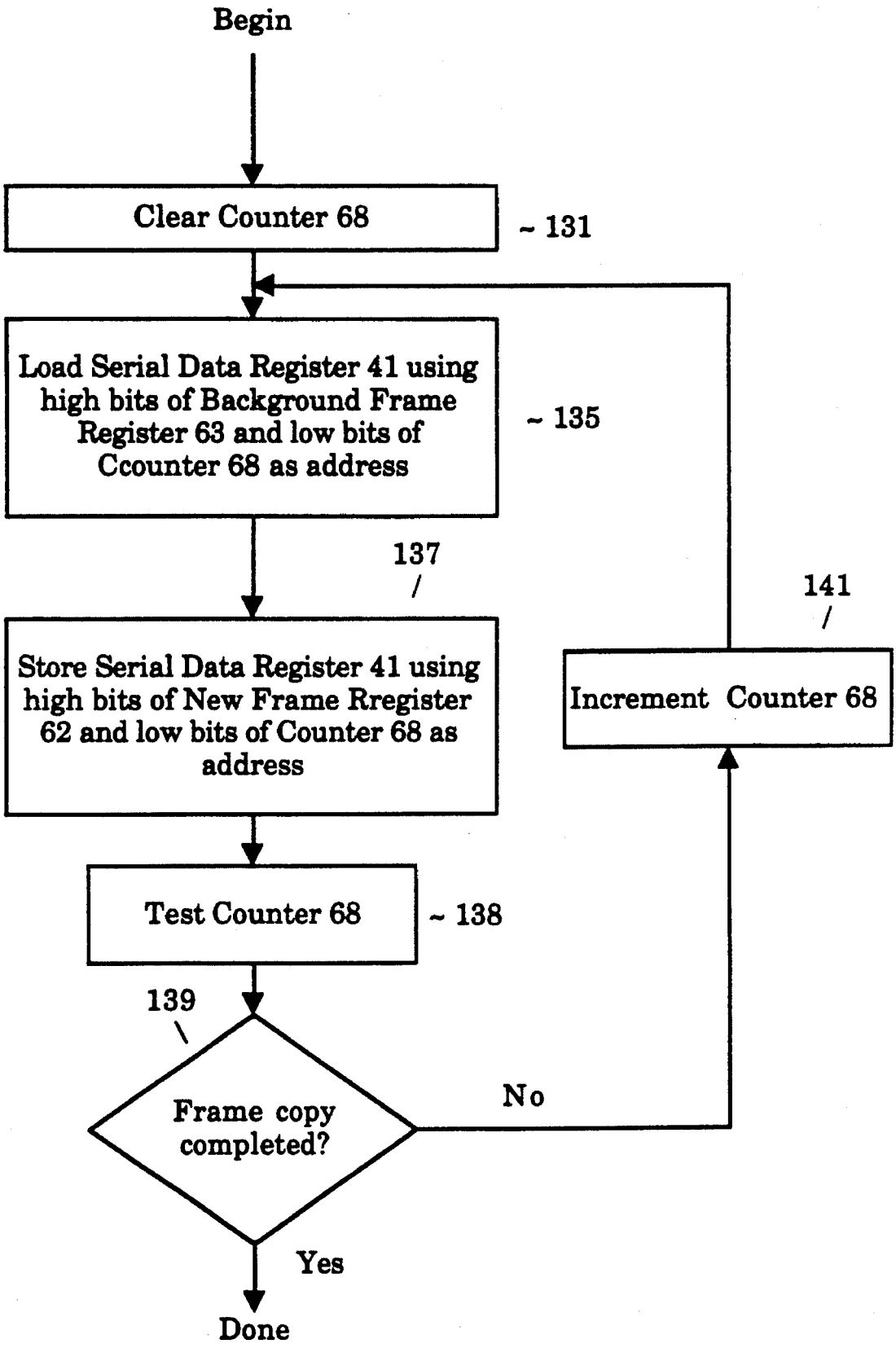
FIG. 7 illustrates a flow diagram of the background copy logic in the display control system of the present invention.

The background copy at step 113 is performed by the background copy logic 65. FIG. 7 provides a flow diagram that explains the operation of the background copy logic 65.

Referring to step 131 of FIG. 7, the background copy logic 65 first clears a counter 68 that will be used in the copy process. The background copy logic 65 next loads the serial data register 41 (of FIG. 1) in a VRAM with a first portion of the background scene at step 135. To obtain a first portion of the background scene, the copy logic 65 creates an address that has the same upper bits of the background frame register 63 and lower bits created from the counter 68. At step 137, the background copy logic 65 then stores the background scene information in the serial data register 41 (of FIG. 1) into the new frame region. To store the information in the new frame region, the copy logic 65 creates an address that has the same upper bits of the new frame register 62 and lower bits created from the counter 68. The counter 68 is thereby used as an index into both background region and the new frame region. At steps 138 and 139, the background copy logic 65 tests the counter 68 to see if the background copy logic 65 has copied the entire frame region. If background copy logic 65 has not copied the entire frame region, the counter 68 is increased at step 141 and the background copy logic 65 goes back to step 135. The background copy logic 65 continues copying information from the background region into the new frame region using the counter 68 as an index until the frame copy has completed. The background copy logic therefore copies the contents of the background region into the new frame region row by row using the serial data register 41 (of FIG. 1) as illustrated in FIG. 5. When the background copy logic 65 reaches the bottom of the new frame region and the background region, the background copy logic 65 is done with the background copy.

In an alternate embodiment, the background copy can be performed during the horizontal retrace periods 93 as illustrated in FIG. 3*a* or during both vertical and horizontal retrace periods. When using the horizontal retrace periods, the background copy logic 65 copies a small portion of the background region into the new frame region during each horizontal retrace period 93 such that the background region is copied into the new frame region piece by piece during successive horizontal retraces. After each portion is copied, the background copy logic 65 must be sure the restore state of the VRAMs in the VRAM array such that the display logic 66 is not disturbed as it scans down the display. For example, the value in the serial data register 41 and the serial data pointer 45 (in FIG. 1) should be restored.

Frame Buffer with Fast Copy Controller Used for Animation

The computer display system of the present invention is ideal for improving the performance of double-buffered animation that is rendered over background scenery. FIGS. 8*a* through 8*k* illustrate how an animation program can use the present invention to render fast double-buffered animation. In each figure, the contents of the display frame register 61, new frame register 62, and background frame register 63 are represented as pointers on the left side of the figure. The contents of the display frame region, new frame region, and background frame region are presented as images that are pointed to by the display frame register 61, new frame register 62, and background frame register 63 respectively.

Figure 8A:
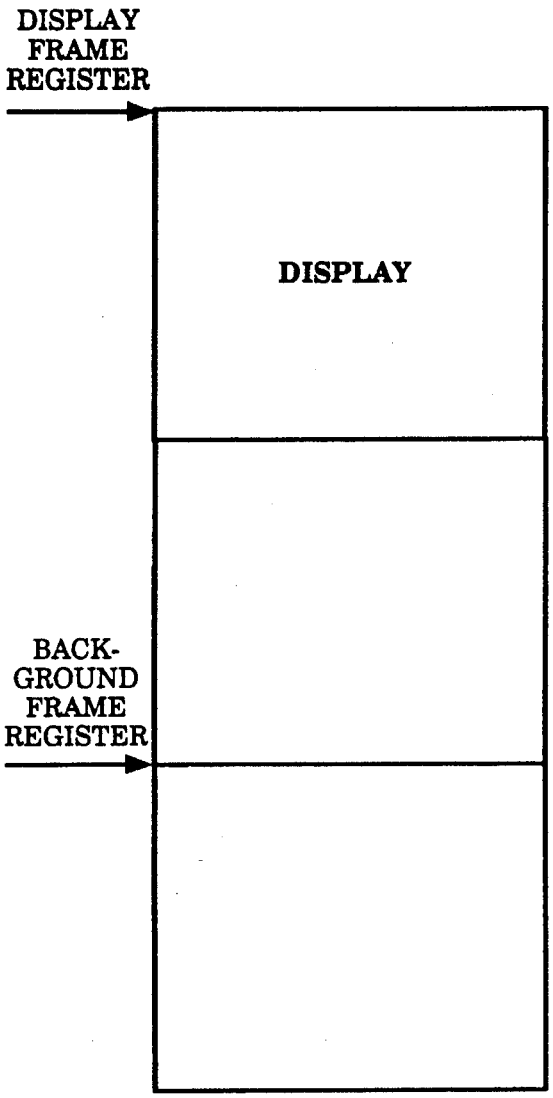
FIGS. 8*a* through 8*m* illustrate how the display control system of the present invention is used to produce real time animation.

The first step is to initialize the three sets of registers and memory regions that will be used. Referring to FIG. 8*a*, the VRAM address space is cleared to provide a black background and the display frame register 61 and the background frame register 63 are initialized to point to a display frame region and a background frame region respectively within the VRAM 55. The new frame register 62 is set to null since it is not yet needed. The display screen 71 always displays the display frame region pointed to by the display frame register 61. Currently, the display frame register 61 points to a cleared-out display frame region so the screen display 71 is blank.

Figure 8B:
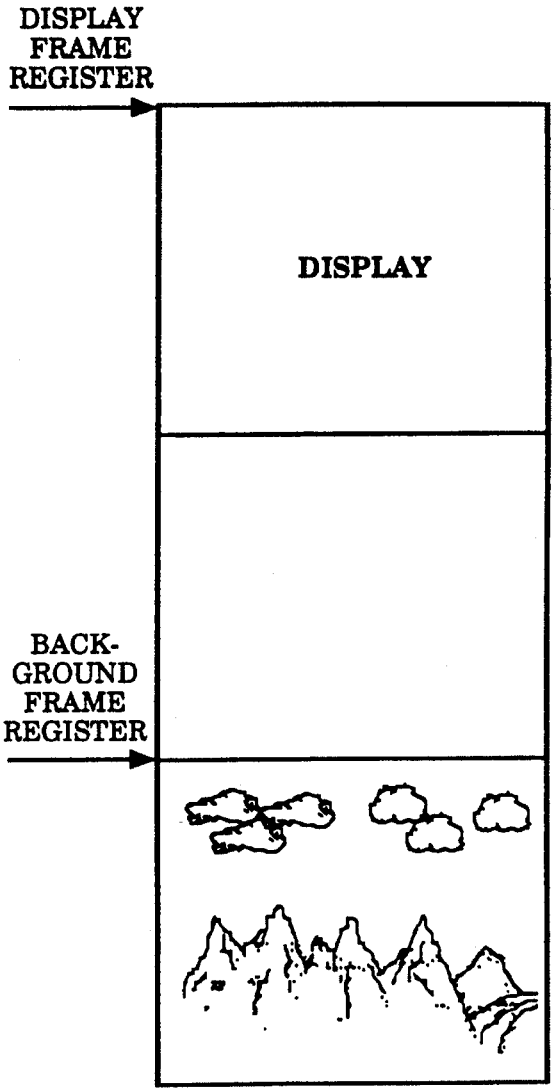

The next step is to create the background scene that will be used as the backdrop for the animation. FIG. 8*b* illustrates the contents of the memory regions after a background mountain scene has been rendered in the background frame region. The mountain scene in the background frame region will be used to provide a background for the animation. The display screen 71 remains blank since the display frame register 61 still points to an empty display frame region.

Figure 8C:
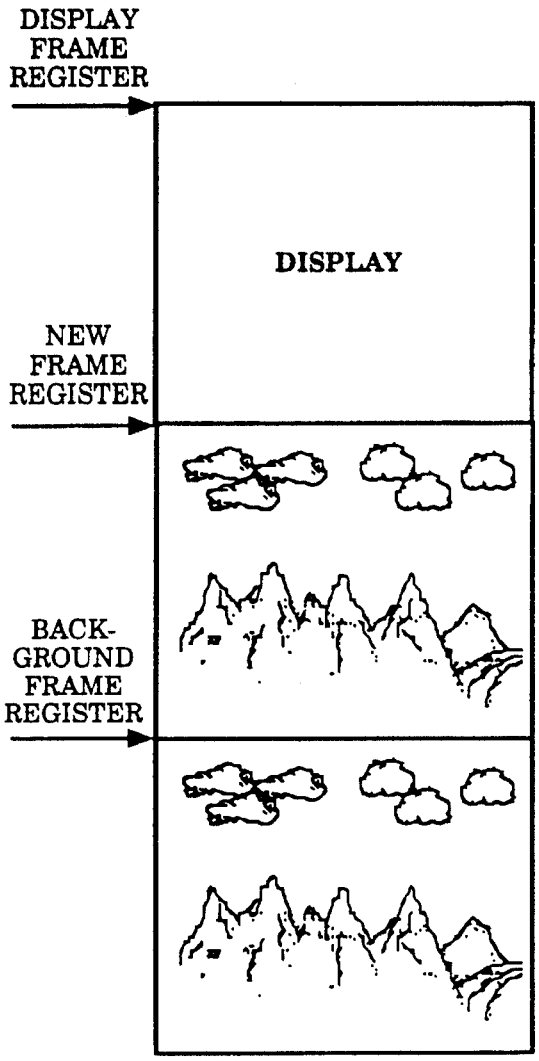

To begin rendering an animation frame, the animation software requests the display control system 51 of the present invention to copy the contents of the background frame region into a new frame region by setting the new frame register 62 to point to an unused region of memory and setting the copy control bit in the control register 64. The display control system 51 then copies the image in the background frame region into the new frame region. FIG. 8*c* illustrates the contents of the memory regions after the display control system 51 performs the background copy.

Figure 8D:
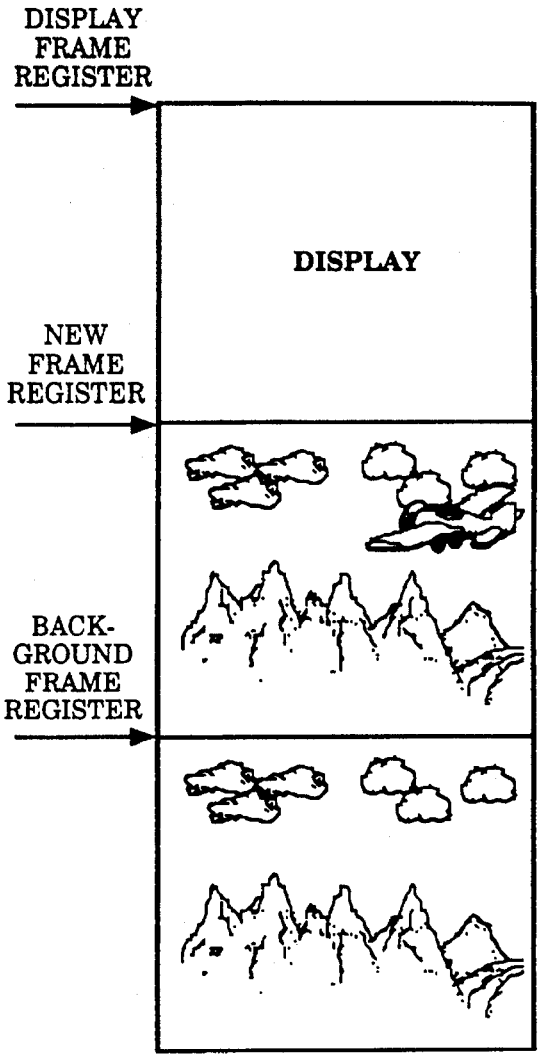

The animation software now renders the first frame of animation over the background scene in the new frame region. FIG. 8*d* illustrates the contents of the memory regions after the animation software has rendered an airplane on the mountain background scene.

Figure 8E:
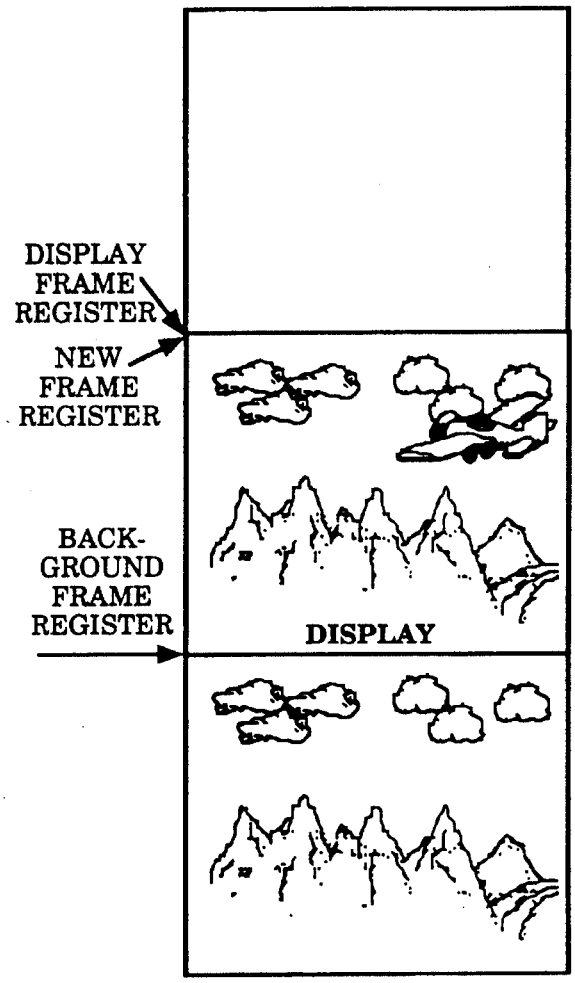

To display the first animation frame, the animation software sets the contents of the display frame register 61 to point to the memory region that contains the airplane. FIG. 8*e* illustrates the contents of the memory regions after the display frame register 61 has been set to point to the first animation frame.

Figure 8F:
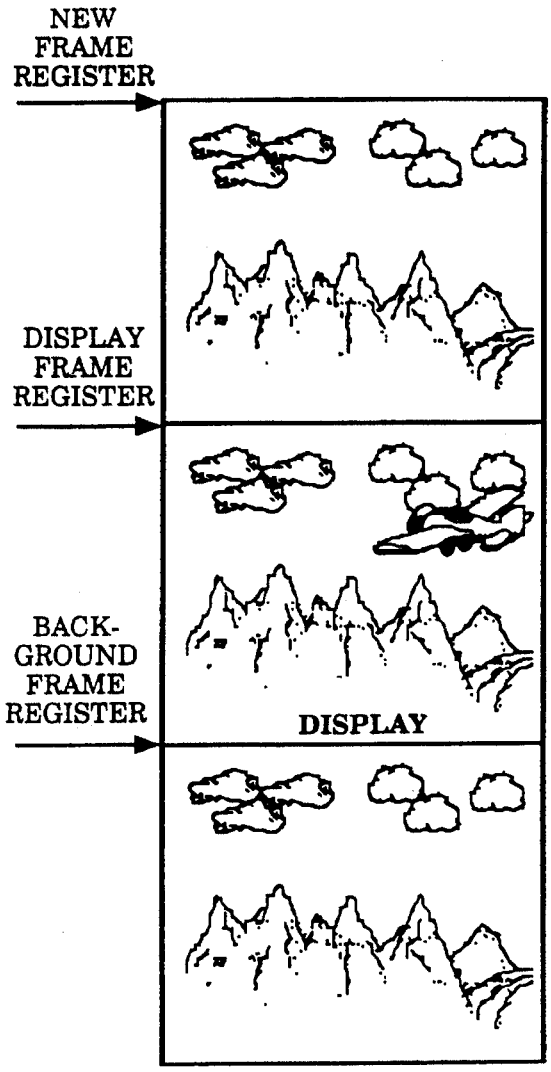

To generate the second animation frame, the animation software first requests the display control system 51 of the present invention to copy the background scene into an unused region of memory. The animation software performs the request by changing the new frame register 62 to point to the old (and now unused) display frame region and sets the copy control bit in the control register 64. The old display region therefore becomes the new frame region. FIG. 8*f* illustrates the contents of the memory regions after the display control system 51 copies the background scene from the background region into the new frame region.

Figure 8G:
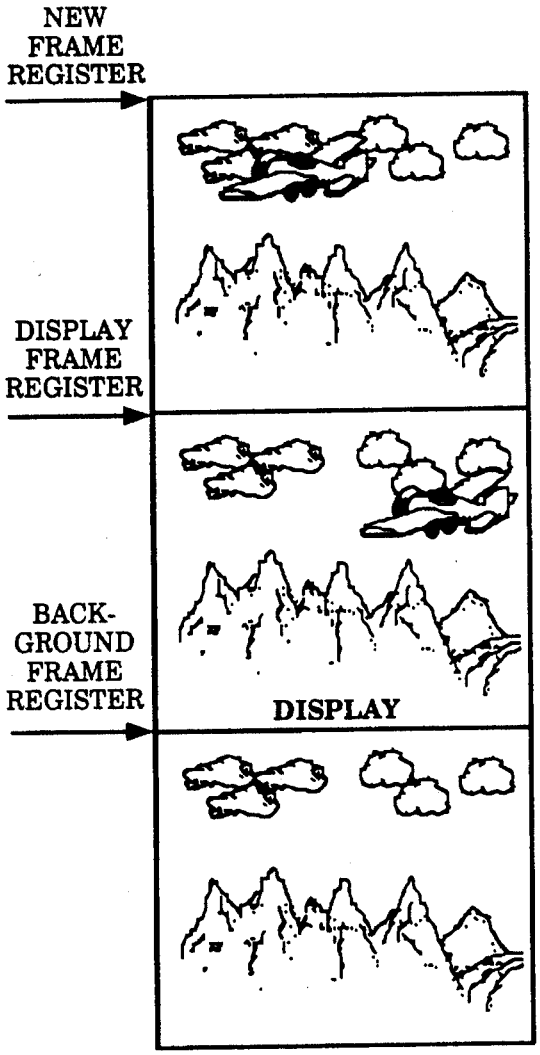

The animation software now renders the second frame of animation in the new frame region on top of the background scene. In the second animation frame, the airplane should move along the mountain background scene. The animation software therefore renders the airplane moved a little to the left. FIG. 8*g* illustrates the contents of the memory regions after the animation software has rendered the second animation frame.

Figure 8H:
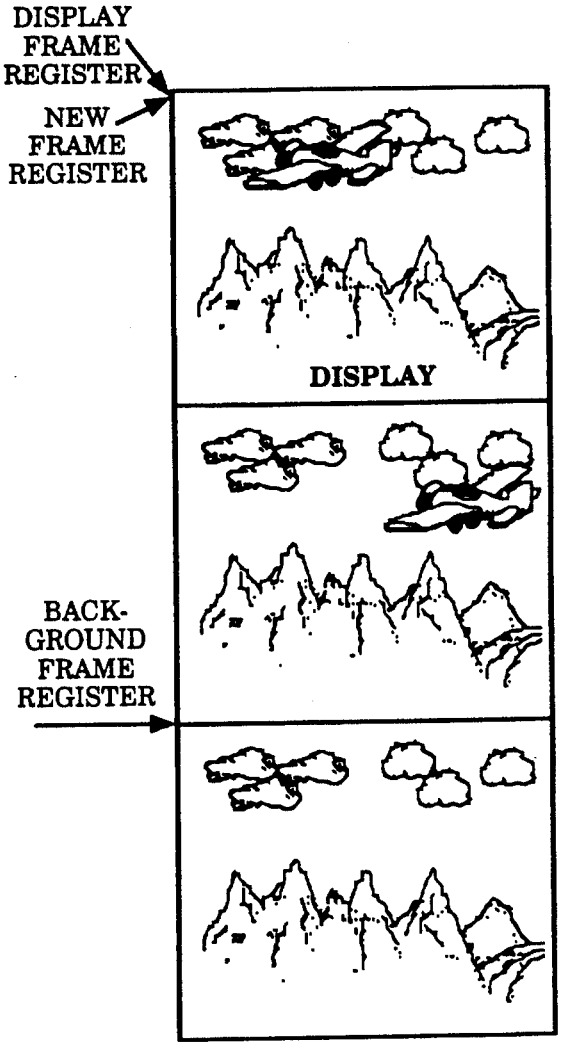

To display the second animation frame, the animation software sets the contents of the display frame register 61 to point to the memory region with the moved airplane. FIG. 8*h* illustrates the contents of the frame buffers after the display frame register 61 has been set to point to the second animation frame.

Figure 8I:
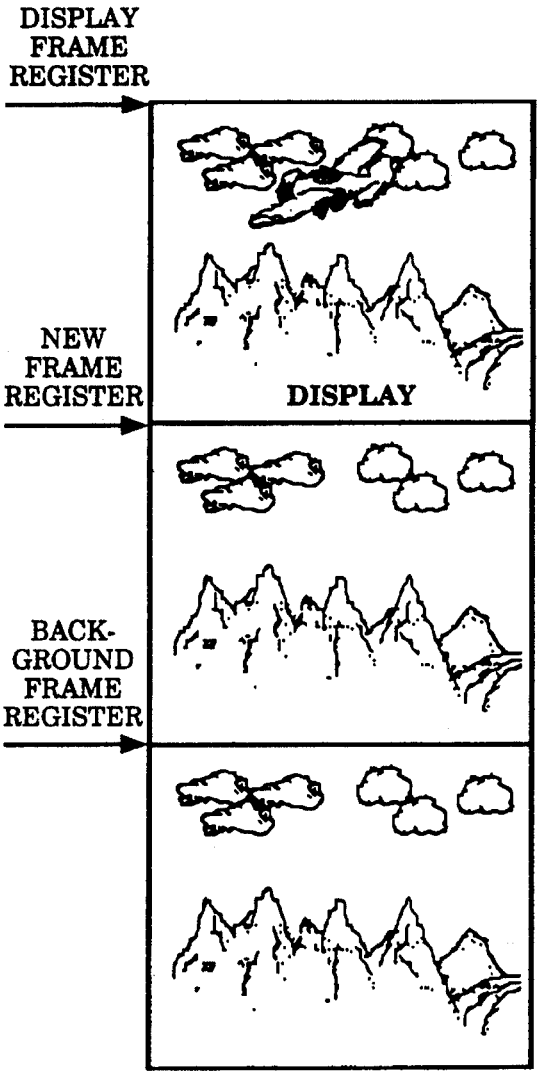

To generate the third animation frame, the animation software requests the display control system 51 of the present invention to copy the background scene into an unused region of VRAM memory. The animation software performs the request by changing the new frame register 62 to point to the previous display frame region. The old display region therefore becomes the new frame region. FIG. 8*i* illustrates the contents of the memory regions after the display control system 51 copies the background scene from the background region into the new frame region. Note that the background copy logic 65 overwrites the first frame of animation that was in that region of memory.

Figure 8J:
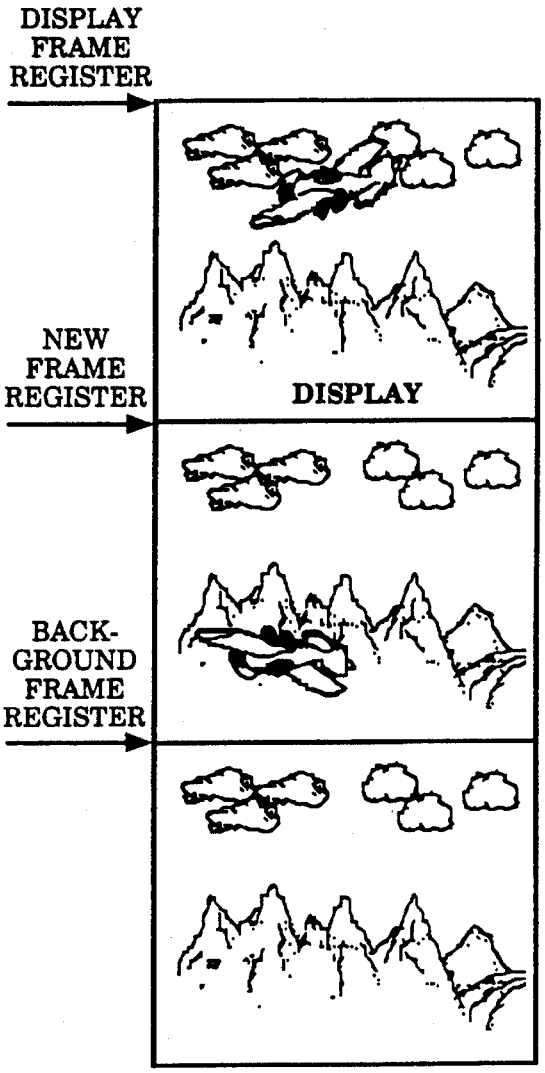

The animation software now renders the third frame of animation in the new frame region on top of the background scene. In the third animation frame, the airplane crashes into the mountains. The animation software therefore renders a crashed airplane on the background mountain scene. FIG. 8*j* illustrates the contents of the memory regions after the animation software has rendered the third animation frame.

Figure 8K:
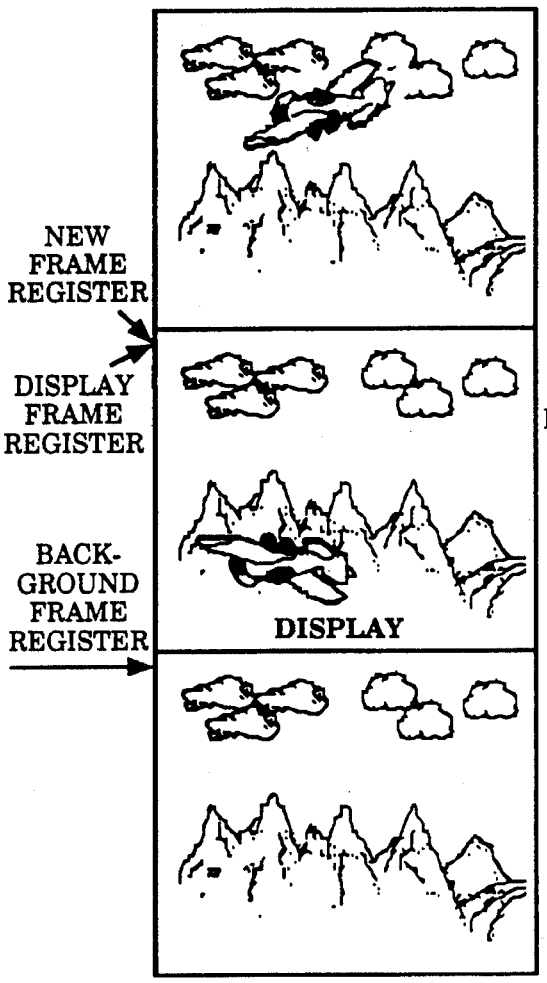

To display the third animation frame, the animation software sets the contents of the display frame register 61 to point to the memory region with the crashed airplane. FIG. 8*k* illustrates the contents of the memory regions after the display frame register 61 has been set to point to the third animation frame.

Figure 8L:
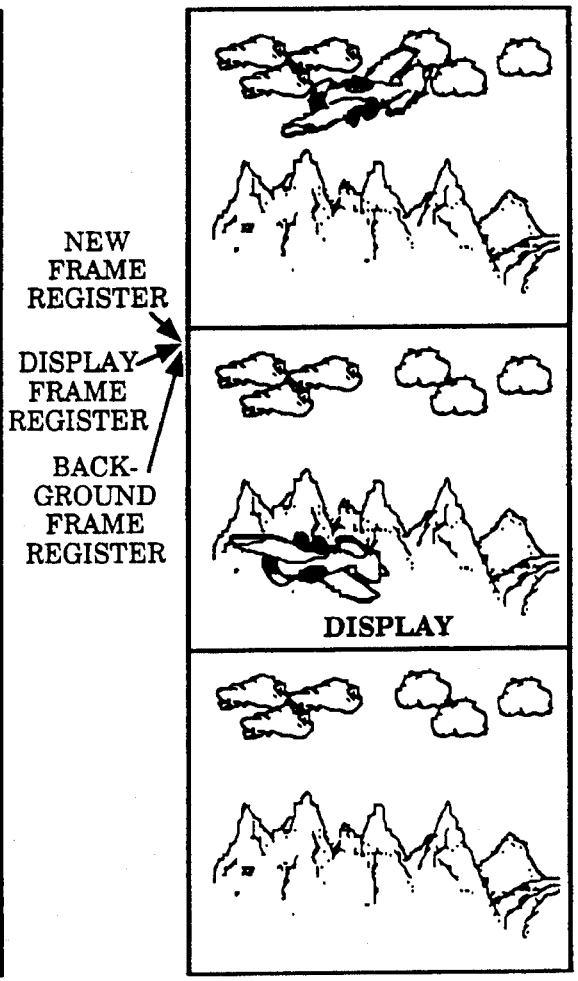

Since it is unlikely that the crashed airplane will move in the future, the crashed airplane can become part of the background scene for future animation frames. The animation software therefore makes the airplane crash scene into the new background scene by setting the background frame register 63 to point to the region of memory that contains the airplane crash scene. FIG. 8l illustrates the contents of the memory regions after the airplane crash scene has been made the background scene.

Figure 8M:
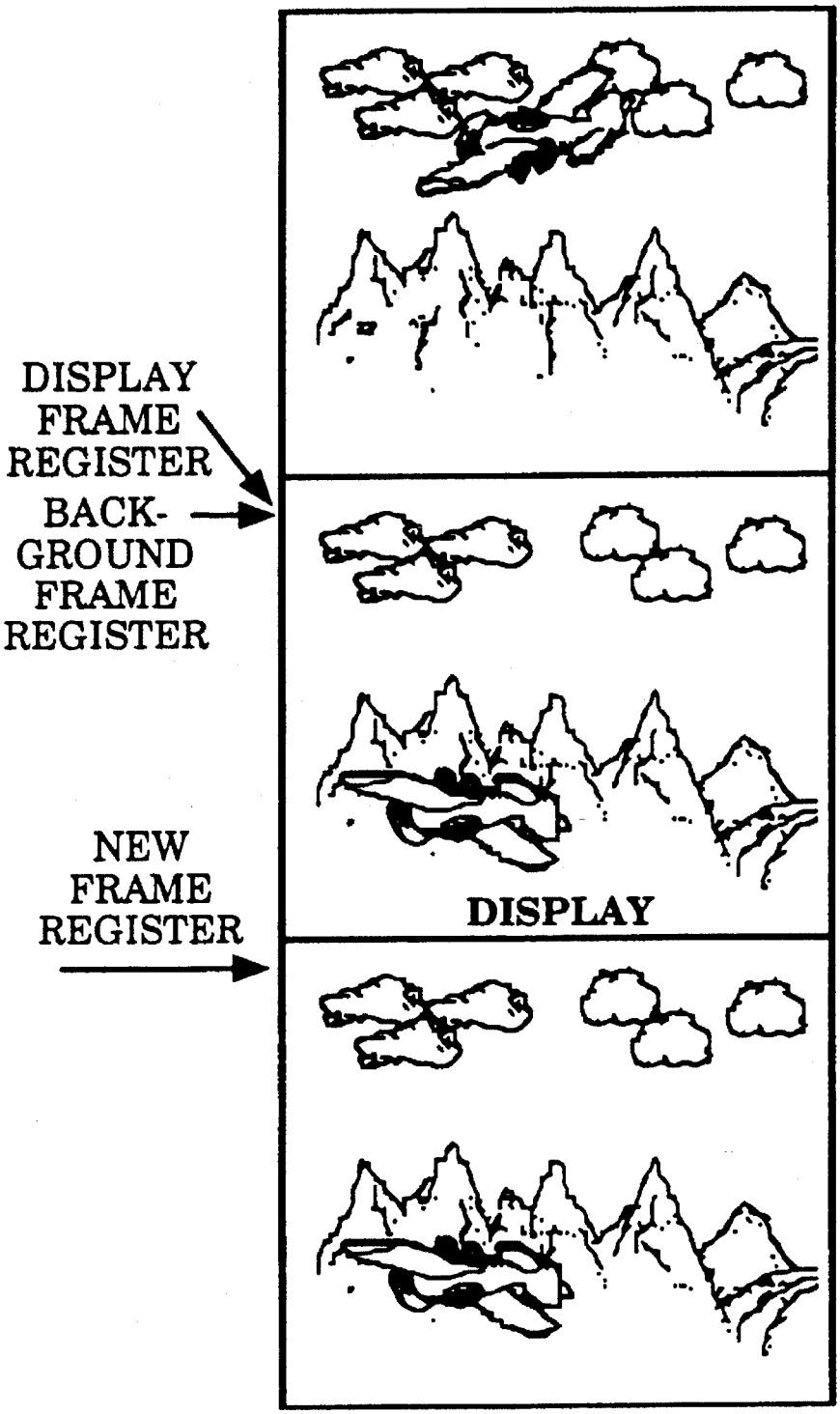

To generate a fourth animation frame, the animation software requests the display control system 51 to copy the background scene into an unused region of memory. The animation software performs the request by changing the new frame register 62 to point to an unused region of memory and then sets the copy control bit in the control register 64. Since the crashed airplane will probably be a permanent fixture of the background scene, the previous mountain scene can be destroyed. Therefore the previous background region becomes the new frame region. Alternatively, the animation software could have used a new region of memory and saved the original mountain scene for future use. FIG. 8*m* illustrates the contents of the memory regions after the display control system 51 copies the background scene from the background region into the new frame region. Note that the background copy logic 65 overwrites the old background scene that was in that region of memory.

The animation software continues rendering successive animation frames by changing the new frame register 62 to point to an unused region of memory to create a new frame in which to render an animation frame. After rendering the animation frame in that region of memory, the software changes the display frame register 61 to point to the newly rendered frame.

The foregoing has described a computer display system with a fast frame copy means. It is contemplated that changes and modifications may be made by one of ordinary skill in the art, to the materials and arrangements of elements of the present invention without departing from the spirit and scope of the invention.

We claim:

1. A method for generating and displaying a sequence of animation frames, said method for use with a frame buffer apparatus comprising at least three data regions, each of the data regions having contents comprising frame data, and said frame buffer apparatus further comprising a display region pointer, a background region pointer, and a new frame region pointer, said method comprising the following steps:

displaying, on a video display device, the contents of the data region addressed by the display region pointer;

copying the contents of the data region addressed by the background region pointer into the data region addressed by the new frame region pointer;

rendering a next frame in the sequence of animation frames;

overlaying the next frame onto the data region addressed by the new frame region pointer;

resetting the display region pointer to identify the data region addressed by the new frame region pointer;

resetting the new frame region pointer to identify the data region previously addressed by the display region pointer;

iteratively repeating the foregoing steps until the sequence of animated frames has been completely displayed on the video display device.

2. The method of claim 1 wherein the step of displaying includes one or more video retrace periods, and the respective steps of copying, rendering, and overlaying are performed during said video retrace periods.

3. The method of claim 2 wherein said one or more video retrace periods include a vertical video retrace period.

4. The method of claim 2 wherein said one or more video retrace periods include a horizontal video retrace period.

5. The method of claim 1, wherein the step of resetting the new frame region pointer is replaced by the following steps:

resetting the background region pointer to address the data region addressed by the display region pointer, thereby updating the contents of the region addressed by the background region pointer; and resetting the new frame region pointer to address the data region previously addressed by the background region pointer.

6. An apparatus for generating and displaying a sequence of animation frames, said apparatus comprising:

a frame buffer apparatus comprising at least three data regions, each of the data regions having contents comprising frame data, and the frame buffer apparatus further comprising a display region pointer, a background region pointer, and a new frame region pointer;

means for displaying, on a video display device, the contents of the data region addressed by the display region pointer;

means for copying the contents of the data region addressed by the background region pointer into the data region addressed by the new frame region pointer;

means for rendering a next frame in the sequence of animation frames;

means for overlaying the next frame onto the data region addressed by the new frame region pointer;

means for resetting the display region pointer to identify the data region addressed by the new frame region pointer;

means for resetting the new frame region pointer to identify the data region previously addressed by the display region pointer;

means for iteratively repeating the foregoing steps until the sequence of animated frames has been completely displayed on the video display device.

7. The apparatus of claim 6 wherein the means for displaying include means for generating one or more video retrace periods, and the respective means for copying, rendering, and overlaying are operative during said video retrace periods.

8. The apparatus of claim 7 wherein said one or more video retrace periods include a vertical video retrace period.

9. The apparatus of claim 7 wherein said one or more video retrace periods include a horizontal video retrace period.

10. The apparatus of claim 6, wherein the means for resetting the new frame region pointer are replaced by the following means:

means for resetting the background region pointer to address the data region addressed by the display region pointer, thereby updating the contents of the region addressed by the background region pointer; and means for resetting the new frame region pointer to address the data region previously addressed by the background region pointer.

* * * * *